United States Patent [19]

Satake et al.

[11] Patent Number: 4,910,185

[45] Date of Patent: Mar. 20, 1990

[54] HEAT-SENSITIVE RECORDING MATERIAL

[75] Inventors: Toshimi Satake; Toshiaki Minami; Tomoaki Nagai; Fumio Fujimura, all of Tokyo, Japan

[73] Assignee: Jujo Paper Co., Ltd., Tokyo, Japan

[21] Appl. No.: 158,544

[22] Filed: Feb. 22, 1988

[30] Foreign Application Priority Data

Feb. 25, 1987 [JP] Japan ..... 62-42424

[51] Int. Cl.[4] ..... B41M 5/18

[52] U.S. Cl. ..... 503/210; 428/690; 503/204; 503/211; 503/212; 503/216; 503/225

[58] Field of Search ..... 427/150–152; 428/195, 207, 690, 913, 914; 503/210–212, 216–218, 225

[56] References Cited

U.S. PATENT DOCUMENTS 4,050,945 9/1987 Suzuki ..... 503/208

*Primary Examiner*—Bruce H. Hess

*Attorney, Agent, or Firm*—Koda & Androlia

[57] ABSTRACT

A heat-sensitive recording material including a support and a color-developing layer comprising an electron doner, an electron acceptor and a fluorescence-dyestuff and/or pigment. The heat-sensitive recording material is superior in both readability in an irradiation of UV-ray and optical readability in near infrared region.

9 Claims, No Drawings

HEAT-SENSITIVE RECORDING MATERIAL

BACKGROUND OF THE INVENTION

1. Field of the Invention

This invention relates to a heat-sensitive recording material in which an optical readability in near infrared region and a position readability in an irradiation of UV-ray are performed appropriately.

2. Prior Art

A heat-sensitive recording sheet that utilizes a heat-color-forming reaction occurring between a colorless or pale-colored chromogenic dyestuff and a phenolic material, or an organic acid is disclosed, for example, in the Japanese Patent Publication Nos. 4160/1968 and 14039/1970 and in the Japanese Laid-Open Patent Publication No. 27736/1973, and is now widely applied for practical use.

In general, a heat-sensitive recording sheet is produced by applying on a support, such as paper, film etc., the coating which is prepared by individually grinding and dispersing a colorless chromogenic dyestuff grinding and dispersing a colorless chromogenic dyestuff and a color-developing material into fine particles, mixing the resultant dispersion with each other and then adding thereto binder, filler, sensitizer, slipping agent and other auxiliaries. The coating, when heated, undergoes instantaneously a chemical reaction which forms a color.

These heat-sensitive recording sheets have now been finding a wide range of applications, including medical or industrial measurement recording instruments, terminal printers of computer and information communication systems, facsimile equipments, printers of electronic calculators, automatic ticket vending machines, and so on.

Further, these heat-sensitive recording sheets comprising the combination of a leuco-dyestuff and a color-developing agent are utilized as thermosensitive labels in POS-system. However, since the color formation is in the visible region, these recording sheets cannot be adapted for reading by a semi-conductor laser in the near infrared region which is used as a bar code scanner.

Besides the heat-sensitive color-developing system in which the above colorless leuco dyestuff is used, a chlate type color-developing system under the use of metal compounds is known.

For examples, the Japanese Patent Publication No. 8787/1957 describes the combined use of iron stearate (electron acceptor) with tannic acid or gallic acid, and the Japanese Patent Publication No. 6485/1959 describes the combined use of an electron acceptor such as silver stearate, iron stearate, gold stearate, copper stearate or mercury behenate with an electron donor such as methyl gallate, ethyl gallate, propyl gallate, butyl gallate or dodecyl gallate.

In increased baggage deliveries, heat-sensitive recording sheets are used as bar-cord labels, wherein high-speed automatic sorter systems are investigated for high-speed treatment of baggages.

The principle of the high-speed automatic sorter system is as follows. A baggage applied with a bar-code label is carried through a belt conveyer into a dark-room, in which the baggage is irradiated with UV-ray of a specific wavelength. The fluorescence-ray from a fluorescence-dyestuff in bar-code label is detected by a fluorescence detector, and the position of bar-code label on the baggage is detected. Then, the information described in bar-code label is read by semi-conductor laser scanner, so that the assortment is automatically performed.

The above system is one of anticipated systems. However, commercial heat-sensitive recording sheets can not be used for these high-speed automatic systems.

SUMMARY OF THE INVENTION

It is a main object to provide a heat-sensitive recording material in which an optical readability in near infrared region and a position readability in an irradiation of UV-rays are appropriately performed.

The above object is achieved by a heat-sensitive recording material having on a substrate a heat-sensitive color-developing layer containing at least an electron acceptor and an electron donor, said electron acceptor and said electron donor reacting with each other. other under the chelate formation, wherein the color-developing recording layer comprises a fluorescence-dyestuff and/or -pigment in which a maximum peak of fluorescence spectrum in irradiation of UV-ray is in a visible wavelength region of 450–700 nm.

DETAILED DESCRIPTION OF THE INVENTION

The kind of electron donor is not limited. However, the preferred electron donor is the metal double salt of higher fatty acid. The metal double salt of higher fatty acid used in this invention means a metal double salt having at least two metal atoms as higher fatty acid-metal in the molecule. Owing to the double salt, the metal double salt of higher fatty acid is clearly different in physical-chemical properties from a higher fatty acid metal salt (metal single salt) containing one metal atom. The metal double salt of higher fatty acid is synthesized by causing the reaction between alkali metal salt or ammonium salt of higher fatty acid and an inorganic metal salt under the use of at least two inorganic metals. Hence, the kind and the mixing ratio of two metal atoms in double salt are unrestrictedly controlled in this synthesis. For example, iron-zinc double salt of behenic acid containing iron and zinc of a mixed ratio 2:1 is obtained by causing a reaction between an aqueous solution of sodium behenate and an aqueous solution of ferric chloride and zinc chloride having a mixed ratio of 2:1.

Suitable metals in the metal double salt of higher fatty acid are other polyvalent metals than alkali metals, for example iron, zinc, calcium, magnesium, aluminum, barium, lead, manganese, tin, nickel, cobalt, copper, silver, quicksilver, etc.; preferable metals are zinc, calcium, aluminum, magnesium and silver. In this invention, there are used metal double salt of higher fatty acid having saturated or unsaturated aliphatic group with 16–35 carbon atoms.

The representative metal double salts of higher fatty acids include the following substances, but they are not limited to these substances.

(1) iron-zinc double salt of stearic acid
(2) iron-zinc double salt of montanic acid
(3) iron-zinc double salt of acid wax
(4) iron-zinc double salt of behenic acid
(5) iron-calcium double salt of behenic acid
(6) iron-aluminum double salt of behenic acid
(7) iron-magnesium double salt of behenic acid
(8) silver-calcium double salt of behenic acid
(9) silver-aluminum double salt of behenic acid
(10) silver-magnesium double salt of behenic acid

(11) calcium-aluminum double salt of behenic acid

These metal double salts of higher fatty acids may be used alone as an electron acceptor of heat-sensitive recording sheet. It is possible to use two or more metal double salts of higher fatty acids, simultaneously.

The electron donors of this invention used with the above metal double salt of higher fatty acid are polyvalent hydroxyaromatic compounds, diphenylcarbazide, diphenylcarbazone, hexamethylenetetramine, spirobenzopyran, 1-formyl-4-phenylsemicarbazide, etc.

Particularly, the polyvalent hydroxyaromatic compounds of the following general formula (I) are most preferred.

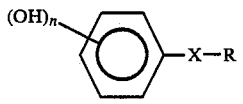

(I)

where R represents alkyl group having 18–35 carbon atoms,

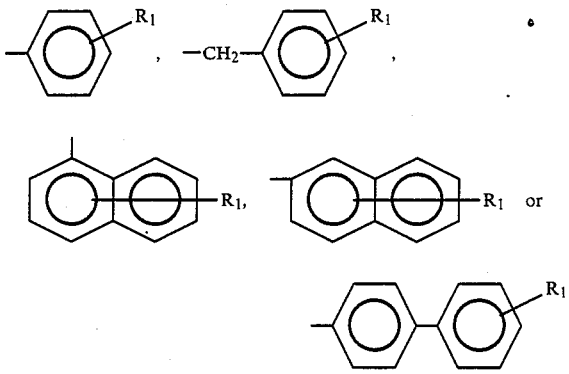

($R_1$ is an alkyl group having 18–35 carbon atoms); n represents an integer from 2 to 3, and —X— represents —$CH_2$—, —$CO_2$—, —CO—, —O—, —CONH— or

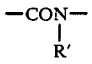

(R' is an alkyl group having 5–30 carbon atoms).

In preparing the coating by dispersing the above polyvalent phenolic derivative in water-system or solvent-system binder, it is required that these phenolic derivatives do not react with the electron-acceptor, and that the solvent-resistance and the dispersing stability of the phenolic derivatives are improved. In this invention, therefore, the substituent group other than the color forming group has a rare carbon number of 18 to 35. Further, it is preferable that the number of hydroxyl groups is 2 to 3 and the hydroxyl groups are adjacent to one another.

These polyvalent phenolic derivatives are used independently. It is possible to use two or more polyvalent phenols, if necessary.

In this invention, the heat-sensitive color-developing layer containing at least an electron acceptor and an electron donor, comprises a fluorescence-dyestuff and/or pigment in which a maximum peak of fluorescence spectrum in irradiation of UV-ray is in a visible wavelength region of 450–700 nm. By the way, it is well-known that a heat-sensitive recording layer contains a fluorescence-brightner. However, the function of the fluorescence-brightner is to increase a brightness by converting invisible UV-rays of 300–400 nm in sunlight into visible blue rays of about 420 nm.

The fluorescence-dyestuffs and/or -pigment of this invention are entirely different from the above fluorescence-brightner in the structure and functions. As the fluorescence-dyestuffs and/or -pigment of this invention, there are included dyestuffs of anthrachinontype, indigotype, azinetype, xanthenetype, acridinetype, diphenylmethanetype, triphenylmethanetype, thiazinetype, thiazoletype and the like.

The fluorescence-dyestuffs and/or -pigment of this invention are described as follows, but they are not limited to the following compound.

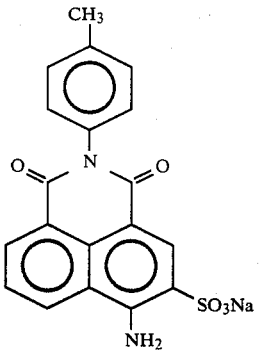

(A) C.I. Acid Y-7(56205)
Brilliant Sulfoflavine

-continued
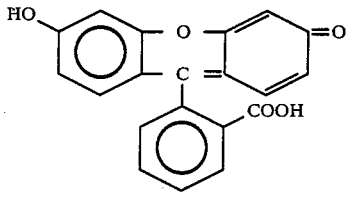
(B) C.I. Acid Y-73 (45350)
Fluoresceine
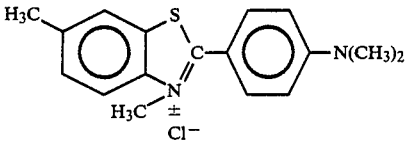
(C) C.I. Basic Y-1(49005)
Thioflavin
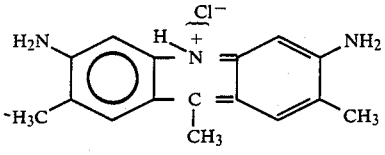
(D) C.I. Basic Y-9(46040)
Basic Yellow HG
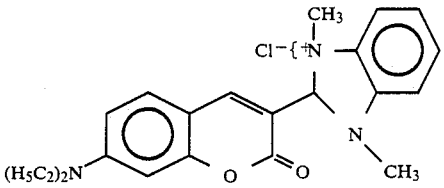
(E) C.I. Basic Y-40
Brilliantflavin IOGFH
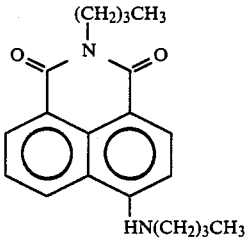
(F) C.I. Solvent Y-43
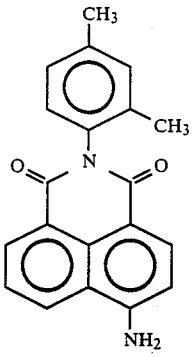
(G) C.I. Solvent Y-44
Kayasetflavine FN -continued
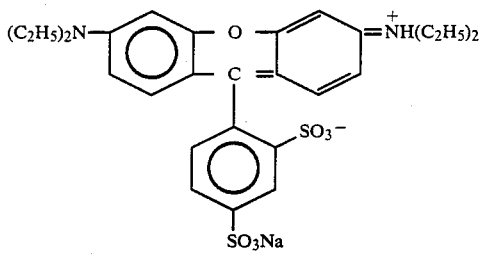
(H) C.I. Acid R-52
Acid Rhodamine
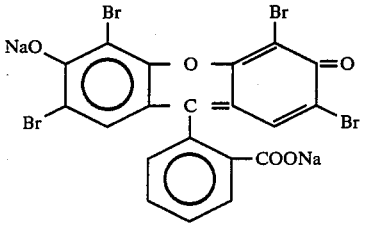
(I) C.I. Acid R-87(45380)
Eosine B
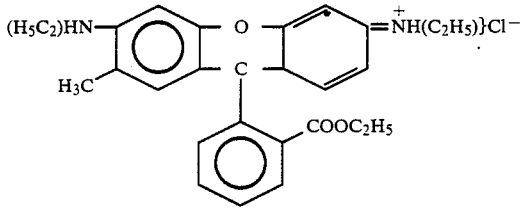
(J) C.I. Basic R-1(45160)
Rhodamine 6G
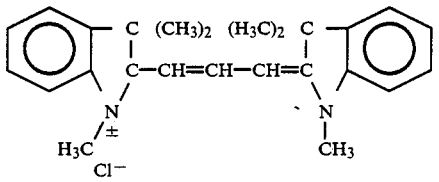
(K) C.I. Basic R-12(48070)
Astraphloxine
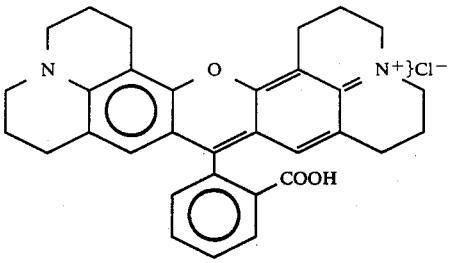
(L) Rhodamine 101

-continued

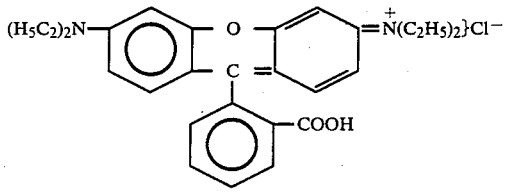

(M) C.I. Basic V-10(45170)

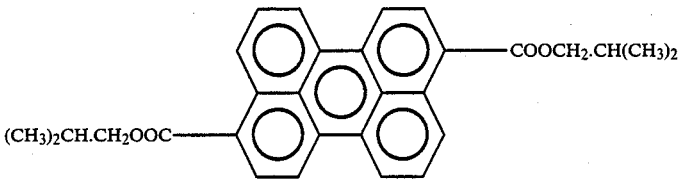

(N) C.I. Solvent G-5(59075)
Sumiplast Yellow FL7G
(Fluorescence-pigment)

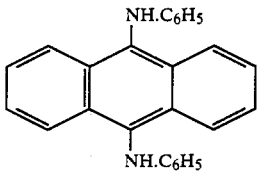

Lumogen L Yellow

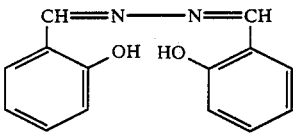

Lumogen Yellow Orange

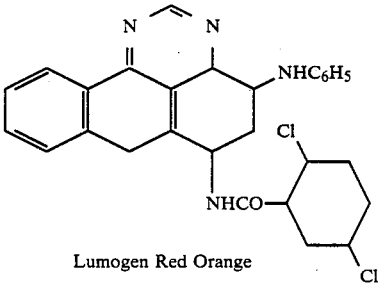

Lumogen Red Orange

Further, fluorescence-pigment includes, for example, plastic particles dyed with Rhodamine B, Rhodamine 6G, Azosolbrilliant Yellow-6G, or basic fluorescence dyestuff, wherein the examples for the plastic are melamine-toluene-sulfoamide resin, triazone resin, acryl resin, polyvinyl chloride resin, etc.

The fluorescence-dyestuff and/or -pigment of this invention can be contained as such in a heat-sensitive color-developing layer, or it can be used as pigment obtained by pulverization of a solid solution which is produced by dissolving the fluorescence-dyestuff in a synthetic resin and as toluene sulfoamide, melamine resin, benzoguanamine resin, acryl resin, polyvinyl chloride, polyamide, polyester, urethane, etc.

The following surface-treated fluorescence-dyestuff is most preferred. The fluorescence dyestuff laminated with a polymerization film is prepared by mixing a polymerization initiator, a vinyl monomer capable of coating the fluorescence dyestuff and a solvent which can dissolve the vinyl monomer and has a lower boiling point than the vinyl monomer, then removing the solvent, and polymerizing the vinyl monomer with a polymerization initiator on the surface of fluorescence-dyestuff particles. Thus treated fluorescence dyestuff is easily dispersed. A leuco dyestuff having near infrared absorption can be used in such amount that the effects of this invention are not deteriorated.

The leuco dyestuff having near infrared absorption absorbs the light of near infrared region (particularly the infrared wavelength region of 700–1500 nm) effectively under its color-development by a heat-fusion reaction with an acidic material.

Examples for the above leuco dyestuff are fluorene dyestuffs, monovinylphthalide dyestuffs, divinylphthalide dyestuffs, fluoran dyestuffs and so on.

Preferable fluorene-type leuco dyestuffs are leuco-dyestuffs having near infrared absorption represented by the following general formula (II) or (III):

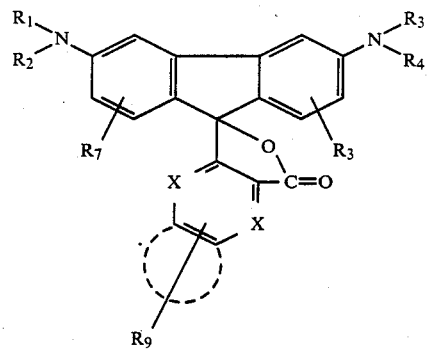

(II)

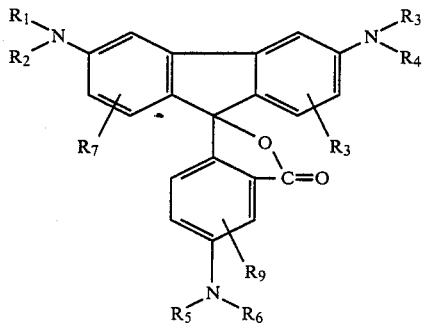

(III)

In the formulae (II) and (III), $R_1$, $R_2$, $R_3$, $R_4$, $R_5$ and $R_6$, independently from each other, represent a hydrogen atom, an alkyl group having 1–18 C-atoms, a cycloalkyl group having 3–7 C-atoms, a lower alkoxy group, a halogenated alkyl group having 1–18 C-atoms, a phenyl group, a substituted phenyl group, a benzyl group or a substituted benzyl group; $R_7$, $R_8$ and $R_9$, independently from each other, represent a hydrogen atom, a halogen atom, a lower alkyl group or a lower alkoxy group; X represents a carbon atom, a nitrogen atom, or a sulfur atom, wherein $R_1$ and $R_2$ together, or $R_3$ and $R_4$ together can alternatively form an optionally o-, s- or second N-atom-containing heterocyclic ring having 4–6 ring-forming atoms with the N-atom to which $R_1$ and $R_2$ or $R_3$ and $R_4$ are attached.

As the binder of this invention, there can be mentioned, for example, a fully saponified polyvinyl alcohol having a polymerization degree of 200–1900, a partially saponified polyvinyl alcohol, carboxylated polyvinyl alcohol, amide-modified polyvinyl alcohol, sulfonic acid-modified polyvinyl alcohol, butyralmodified polyvinyl alcohol, other modified polyvinyl alcohol, hydroxyethyl cellulose, methyl cellulose, carboxymethyl cellulose, stryrene/malic acid anhydride copolymers, styrene/butadiene copolymers, cellulose derivatives such as ethyl cellulose, acetyl cellulose, etc.; polyvinyl chloride, polyvinyl acetate, polyacryl amide, polyacrylic acid ester, polyvinyl butyrol, polystyrol and copolymers thereof; polyamide resin, silicone resin, petroleum resin, terpene resin, ketone resin and cumaron resin.

These polymeric materials may be used after they were dissolved in a solvent such as water, alcohol, ketone, ester hydrocarbon, etc., or after they were emulsified or dispersed in water or a solvent other than water.

The species and the amount of an electron acceptor such as metal double salt of higher fatty acid, an electron donor such as polyvalent phenol derivative, fluorescence-dyestuff and/or -pigment, binder, and other ingredients are determined depending upon the perfomance and recording apptitude required for the heat-sensitive recording material, and are not otherwise limited. However, in ordinary cases, it is suitable to use 1–6 parts by weight of electron donor, 1–10 parts by weight of fluorescence-dyestuff and/or -pigment, 2–15 parts by weight of filler, and to add 0.5–4 parts by weight of a binder, based on 1–9 parts by weight of an electron acceptor, for example, metal double salt of higher fatty acid.

The aimed heat-sensitive recording material may be obtained by coating the above coating color on a support such as paper, synthetic paper, film, etc.

The above electron acceptor, the above electron donor, if necessary, basic colorless dyestuff are ground down to a particle size of several microns or smaller by means of a grinder or emulsifier such as a ball mill, attritor, sand grinder, etc. and binder and various additives in accordance with the purpose, are added thereto to prepare coating colors. The additives of this invention are, for example, inorganic or organic fillers such as silica, calcium carbonate, kaolin, calcined kaolin, diatomaceous earth, talc, titanium dioxide, aluminum hydroxide; releasing agent such as metal salts of fatty acids, etc.; slipping agent such as waxes, etc.; UV-absorbers such as benzophenone type or triazole type; water-resistance agent such as glyoxal, etc.; dispersant; anti-foamer; etc.

Function

The reason why a heat-sensitive recording material of this invention is superior in the optical readability in the near infrared region is explained as follows. When there is formed a complex color-forming material obtained by a heat-melt reaction between a metal double salt of higher fatty acid as electron acceptor and an electron donor, e.g. polyvalent phenolic derivative, a colored image is obtained in visible light and in the light of the near infrared region (wavelength region of 700–1500 nm). Further, since the heat-sensitive recording layer contains a fluorescence-dyestuff and/or -pigment in which a maximum peak of fluorescence spectrum in irradiation of UV-rays is in a visible wavelength region of 450–700 nm, a position readability in an irradiation of UV-rays are appropriately performed. For example, a baggage applied with a bar-code label is carried through a belt conveyer into a darkroom, in which the baggage is irradiated with UV-ray of a specific wavelength. The fluorescence-ray from a fluorescence-dyestuff and/or -pigment in bar-code label is detected by a fluorescence detector, and the position of bar-code label on the baggage is detected.

Examples

This invention will be described by way of examples hereunder. Throughout the specification the parts are units by weight.

Synthetic Examples 1000 parts of a fluorescence-dyestuff "Thioflavine" (dyestuff-symbol C), 350 parts of ethylether, 70 parts of styrene monomer, 2 parts of 2,2'-azobis-(2,4-dimethylvaleronitrile) and 5 parts of dialkylsulfosuccinic acid ester-salt were charged in a ball mill, and then kneaded for 2 hours to prepare an uniform dispersion. After recovering the solvent, this dispersion was polymerized in a constant-temperature bath at 65° C., and then heated to 90° C. to remove the rest monomer. In this manner, fine particles of styrene resin dyed with thioflavine were obtained.

EXAMPLE 1

(Test Nos. 1–4)

| | |
|---|---|
| Liquid A (dispersion of electron acceptor) | |
| metal double salt of higher fatty acid (see Table 1) | 9.0 parts |
| 10% aqueous solution of polyvinyl alcohol | 10.0 parts |
| water | 6.0 parts |
| Liquid B (dispersion of electron donor) | |
| polyvalent phenolic derivative (see Table 1) | 6.0 parts |
| zinc stearate | 1.5 parts |
| 10% aqueous solution of polyvinyl alcohol | 13.75 parts |
| water | 8.25 parts |
| Liquid C (dispersion of fluorescence-dyestuff) | |
| fluorescene-dyestuff (see Table 1) | 5.0 parts |
| 10% aqueous solution of polyvinyl alcohol | 10.0 parts |
| water | 6.0 parts |

The liquids A, B and C of the above-mentioned composition were individually ground to a particle size of microns by attritor. Then, the dispersions were mixed in the following portion to prepare the coating color.

| | |
|---|---|
| Liquid A | 25.0 parts |
| Liquid B | 29.5 parts |
| Liquid C | 21.0 parts |
| Kaolin clay (50% aqueous dispersion) | 12.0 parts |

The coating color was applied on one side of a base paper weighing 50 g/m$^2$ at a coating weight of 6.0 g/m$^2$ and was then dried. The resultant paper was treated to a smoothness of 200–600 seconds by a supercalender. In this manner, a heat-sensitive recording sheet was obtained.

EXAMPLE 2

(Test Nos. 5–12)

A heat-sensitive recording sheet was obtained in the same manner as in Example 1 except using Liquid D instead of Liquid C.

| | |
|---|---|
| Liquid D | |
| Calcium carbonate | 2 parts |
| 10% aqueous solution of polyvinyl alcohol | 30 parts |
| zinc stearate | 0.5 part |
| fluorescence dyestuff (40% dispersion, manufactured by Sinloihi Co.; Sinloihi color base SP-X Series, X = 13 – 17, 27, 37 and 47) | 12.5 parts |
| [Comparative Example (Test Nos. 13-16)] | |
| Liquid A (dispersion of electron acceptor) | |
| metal double salt of higher fatty acid (see Table 2) | 9.0 parts |
| 10% aqueous solution of polyvinyl alcohol | 10.0 parts |
| water | 6.0 parts |
| Liquid B (dispersion of electron donor) | |
| polyvalent phenolic derivative (see Table 2) | 6.0 parts |
| zinc stearate | 1.5 parts |
| 10% aqueous solution of polyvinyl alcohol | 13.75 parts |
| water | 8.25 parts |

The liquids A and B of the above-mentioned composition were individually ground to a particle size of 3 microns by attritor. Then, the dispersions were mixed in the same portion as in Example to prepare the coating color

| | |
|---|---|
| Liquid A | 25.0 parts |
| Liquid B | 29.5 parts |
| Kaolin clay (50% aqueous dispersion) | 12.0 parts |

Using the above coating color, a heat-sensitive recording sheet was obtained in the same manner as in Example 1.

The heat-sensitive recording sheets obtained in Examples and Comparative Examples were tested for the following articles. The test results were shown in Tables 1 and 2.

TABLE 1

Test results

| | Test No. | Electron acceptor | Electron doner | Fluorescence-dyestuff (dyestuff-symbol) | Image density (1) | Infrared reflectance (%) (2) | Fluorescence readability (3) |
|---|---|---|---|---|---|---|---|
| Example 1 | 1 | Fe.Zn double salt of behenic acid (2:1)* | 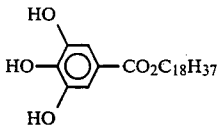 | Basic Y-1 Thioflavine (C) | 1.01 | 15 | good |
| | 2 | Fe.Ca double salt of behenic acid (2:1) | 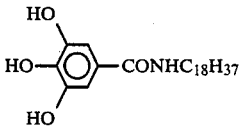 | Acid R-52 Acid Rhodamine (H) | 0.99 | 17 | good |

TABLE 1-continued

| | Test No. | Electron acceptor | Electron doner | Fluorescence-dyestuff (dyestuff-symbol) | Image density (1) | Infrared reflectance (%) (2) | Fluorescence readability (3) |
|---|---|---|---|---|---|---|---|
| | | | Test results | | | | |
| | 3 | Ag.Al double salt of stearic acid (2:1) | 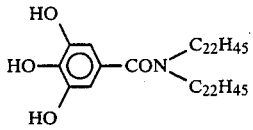 | Basic V-10 (M) | 1.00 16 | good | |
| | 4 | Ag.Mg double salt of stearic acid (2:1) | 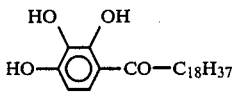 | Solvent G-5 Sumiplast Yellow-FL7G (N) | 0.98 | 17 good | |
| Example 2 | 5 | Fe.Ca double salt of behenic acid (2:1) | 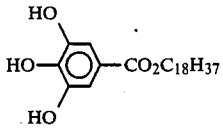 | SP-13 Red | 1.00 | 14 | good |
| | 6 | Fe.Zn double salt of behenic acid (2:1) | " | SP-14 Orange | 0.98 | 15 | good |
| | 7 | Fe.Al double salt of behenic acid (2:1) | 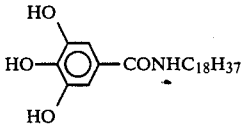 | SP-15 Lemon yellow | 1.02 | 14 | good |
| | 8 | Fe.Mg double salt of behenic acid (2:1) | " | SP-16 Orange yellow | 0.99 | 16 | good |

*(2:1) means a mole ratio of metals in a metal double salt of higher fatty acid.

TABLE 2

| | Test No. | Electron acceptor | Electron doner | Fluorescence-dyestuff (dyestuff symbol) | Image density (1) | Infrared reflecteance (%) (2) | Fluorescence readability (3) |
|---|---|---|---|---|---|---|---|
| | | | Test results | | | | |
| Example | 9 | Fe.Zn double salt of behenic acid (2:1) | 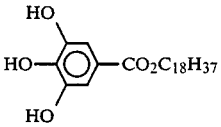 | SP-17 Pink | 1.01 | 15 | good |
| | 10 | Fe.Ca double salt of behenic acid (2:1) | 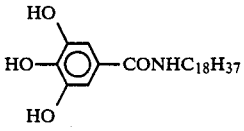 | SP-27 Rose | 0.99 | 17 | good |
| | 11 | Ag.Al double salt of stearic acid (2:1) | 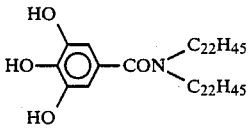 | SP-37 Magenta | 1.00 | 16 | good |
| | 12 | Ag.Mg double salt of stearic acid (2:1) | 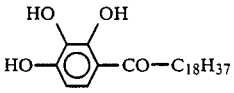 | SP-47 Rubine | 0.98 | 17 | good |
| Comparative Example | 13 | Fe.Zn double salt of behenic acid (2:1) | 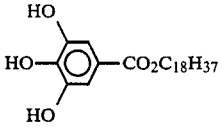 | — | 1.01 | 15 | bad |
| | 14 | Fe salt of behenic acid | 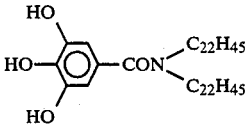 | — | 0.96 | 31 | bad |

TABLE 2-continued

| Test No. | Electron acceptor | Electron doner | Fluorescence-dyestuff (dyestuff symbol) | Image density (1) | Infrared reflecteance (%) (2) | Fluorescence readability (3) |
|---|---|---|---|---|---|---|
| | | Test results | | | | |
| 15 | Fe salt of stearic acid | 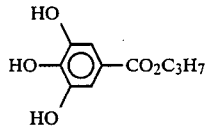 | — | 0.47 | 58 | bad |
| 16 | Ag salt of stearic acid | 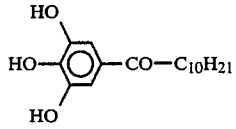 | — | 0.64 | 48 | bad |

Note
(1)Image density: A heat-sensitive recording sheet was recorded in pulse width of 3.2 milliseconds and an impressed voltage of 18.03 volts by using the thermal facsimile KB-4800 manufactured by TOSHIBA CORPORATION and the optical density of the recorded image was measured by a Macbeth densitometer. (using RD-514 and amber filter, the same in the following)
(2)Infrared reflectance (%): The infrared reflectance of the image portion recorded by a the method of Note (1) was wavelength: 800 nm)
(3)In a darkroom, a heat-sensitive recording material is irradiated with a UV-ray (a UV-ray of the main wave-lenth of 365 nm), and the produced fluoresence is observed with eyes.

Effects of this Invention

The Effects of this invention are as follows:

(1) superior readability in an irradiation of UV-ray, and (2) better optical readability in near infrared region.

What is claimed is:

1. A heat-sensitive recording material comprising a support having a heat-sensitive color-developing layer, wherein said heat-sensitive color-developing layer comprises an electron acceptor and electron donor which are reactive to form a metal chelate, and a fluorescence-dyestuff and/or fluorescence-pigment in which a maximum peak of fluorescence in irradiation of UV-rays is in a visible wavelength region of 450–700 nm.

2. The heat-sensitive recording material according to claim 1, wherein said electron acceptor comprises a metal double salt of higher fatty acid having 16–35 carbon atoms.

3. The heat-sensitive recording material according to claim 2, wherein said metal double salt of higher fatty acid comprises at least two metals selected from a group consisting of iron, zinc, calcium, magnesium, aluminum, barium, lead, manganese, tin, nickel, cobalt, copper, silver and quicksilver.

4. The heat-sensitive recording material according to claim 1, wherein said electron donor is at least one member selected from a group consisting of polyvalent hydroxyaromatic compound, diphenylcarbazide, diphenylcarbazone, hexamethylenetetramine, spirobenzopyran, and 1-formyl-4-phenylsemicarbazide.

5. The heat-sensitive recording material according to claim 4, wherein said electron donor is a polyvalent hydroxyaromatic compound represented by the following general formula (I):

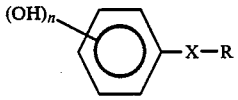

(I)

wherein R represents alkyl group having 18–35 carbon atoms,

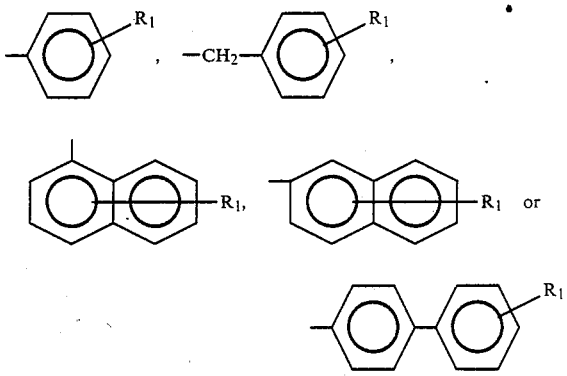

($R_1$ is an alkyl group having 18–35 carbon atoms); n represents an integer from 2 to 3, and —X— represents —$CH_2$—, —$CO_2$—, —CO—, —O—, —CONH— or $$-\underset{\underset{R'}{|}}{CON}-$$

(R′ is an alkyl group having 5–30 carbon atoms).

6. The heat-sensitive recording material according to claim 1, wherein said fluorescence-dyestuff and/or -pigment is at least one member selected from a group consisting of indigo, azine, xanthene, acridine, diphenylmethane, triphenylmethane, thiazine and thiazole compounds.

7. The heat-sensitive recording material according to claim 1, wherein said color-developing layer comprises 1–6 parts by weight of said electron donor, 1–10 parts by weight of fluorescence-dyestuff and/or -pigment, 2–15 parts by weight of filler and 0.5–4 parts by weight of binder, based on 1–9 parts by weight of said electron acceptor.

8. The heat-sensitive recording material according to claim 1, wherein said color-developing layer lies on the support.

9. The heat-sensitive recording material according to claim 8, wherein said support is at least one member selected from a group consisting of paper, synthetic paper and film.

* * * * *